US006250286B1

(12) United States Patent
Hoenig et al.

(10) Patent No.: US 6,250,286 B1
(45) Date of Patent: Jun. 26, 2001

(54) METHOD AND DEVICE FOR CONTROLLING AT LEAST ONE SOLENOID VALVE

(75) Inventors: Guenter Hoenig, Ditzingen; Dirk Mentgen, Schwieberdingen; Bernd Herrmann, Sachsenheim; Andreas Eichendorf, Schorndorf; Hansjoerg Bochum, Leinfelden; Ulf Pischke, Stuttgart; Juergen Eckhardt, Markgroeningen; Reinhard Gantenbein, Sersheim; Jürgen Ulm, Eberdingen, all of (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/361,922

(22) Filed: Jul. 27, 1999

(30) Foreign Application Priority Data

Jul. 28, 1998 (DE) ..... 198 33 830

(51) Int. Cl.[7] ..... F02M 51/00
(52) U.S. Cl. ..... 123/490; 361/154
(58) Field of Search ..... 123/490; 361/154, 361/152

(56) References Cited

U.S. PATENT DOCUMENTS 4,764,840 * 8/1988 Petrie et al. ..... 361/154
5,400,757 * 3/1995 Ishibashi et al. ..... 123/490
5,430,601 * 7/1995 Burcham ..... 36/154
5,469,825 * 11/1995 Golab et al. ..... 123/490
5,477,831 * 12/1995 Akaki et al. ..... 123/490
5,632,250 5/1997 Kato et al. .

FOREIGN PATENT DOCUMENTS 195 39 071 9/1996 (DE) .
0 893 594 1/1999 (EP) .
60-134842 9/1985 (JP) .
6-241137 8/1994 (JP) .
60-26135 2/1995 (JP) .
7-103356 4/1995 (JP) .
814 4859 6/1996 (JP) .
9-317540 12/1997 (JP) .
10-77925 3/1998 (JP) .
11-182378 7/1999 (JP) .
11-351039 12/1999 (JP) .

* cited by examiner

*Primary Examiner*—John Kwon
(74) *Attorney, Agent, or Firm*—Kenyon & Kenyon

(57) ABSTRACT

A method and a device for driving at least one solenoid valve used for controlling the injection of fuel into an internal combustion engine. At the start of the driving (activation), the solenoid valve is supplied with a booster voltage that is elevated as compared to that used for the further driving. The energy and/or power output received by the solenoid valve at the start of the driving is able to be influenced as a function of the operating state of the internal combustion engine.

16 Claims, 4 Drawing Sheets

METHOD AND DEVICE FOR CONTROLLING AT LEAST ONE SOLENOID VALVE

BACKGROUND INFORMATION

A method and a device for driving at least one solenoid valve are described in German Patent No. 195 39 071. The solenoid valve is installed in an internal combustion engine to control the metering of fuel. To perform an accelerated start-up (energizing), the voltage applied to a booster capacitor is fed to the load. This means that the voltage supplied to the load at the start of the driving (activation) is elevated as compared to that used for the further driving.

Because of the high booster voltage and the energy extracted from the booster capacitor during injection, very high power losses occur in the output stage. This is due particularly to the fact that the voltage is generated using a dissipative DC/DC converter. Smaller booster voltages result in smaller booster currents, shorter booster times, a smaller power loss, but also in longer switching times for the solenoid valve.

SUMMARY OF THE INVENTION

An object of the present invention is to reduce power loss, while at the same time minimizing the effect of prolonged switching times (operating-time delays) to the greatest extent possible.

Due to fact that the energy or the power output is able to be influenced as a function of the operating state at the start of activation, the power loss dissipation can be substantially reduced with the effects of the resultant prolonged switching times being minimal. The energy or the power output is preferably influenced by one or a plurality of the variables booster voltage, booster current or booster time. In particular, the power loss dissipation is reduced by lowering the booster voltage and/or the booster current and/or the booster time in specific operating states.

Short switching times can be achieved for those operating states which require them, by specifying the energizing conditions, i.e., the energy or the power output supplied to the solenoid valve, as a function of the operating parameters. Also, shorter time intervals between two injections can be achieved in certain operating states. Moreover, the power loss dissipation occurring in the control unit can be reduced. This facilitates integration of the output stage and the control unit in one housing. In addition, the DC/DC converter used can be rated for a lower capacity. The result is a substantial reduction in cost outlay. The power output required of the voltage supply is also reduced.

DETAILED DESCRIPTION

The device according to the present invention is preferably used in internal combustion engines. In these engines, the metering of fuel is controlled by electromagnetic valves. These electromagnetic valves are also referred to in the following as consumers (loads).

Figure 1:
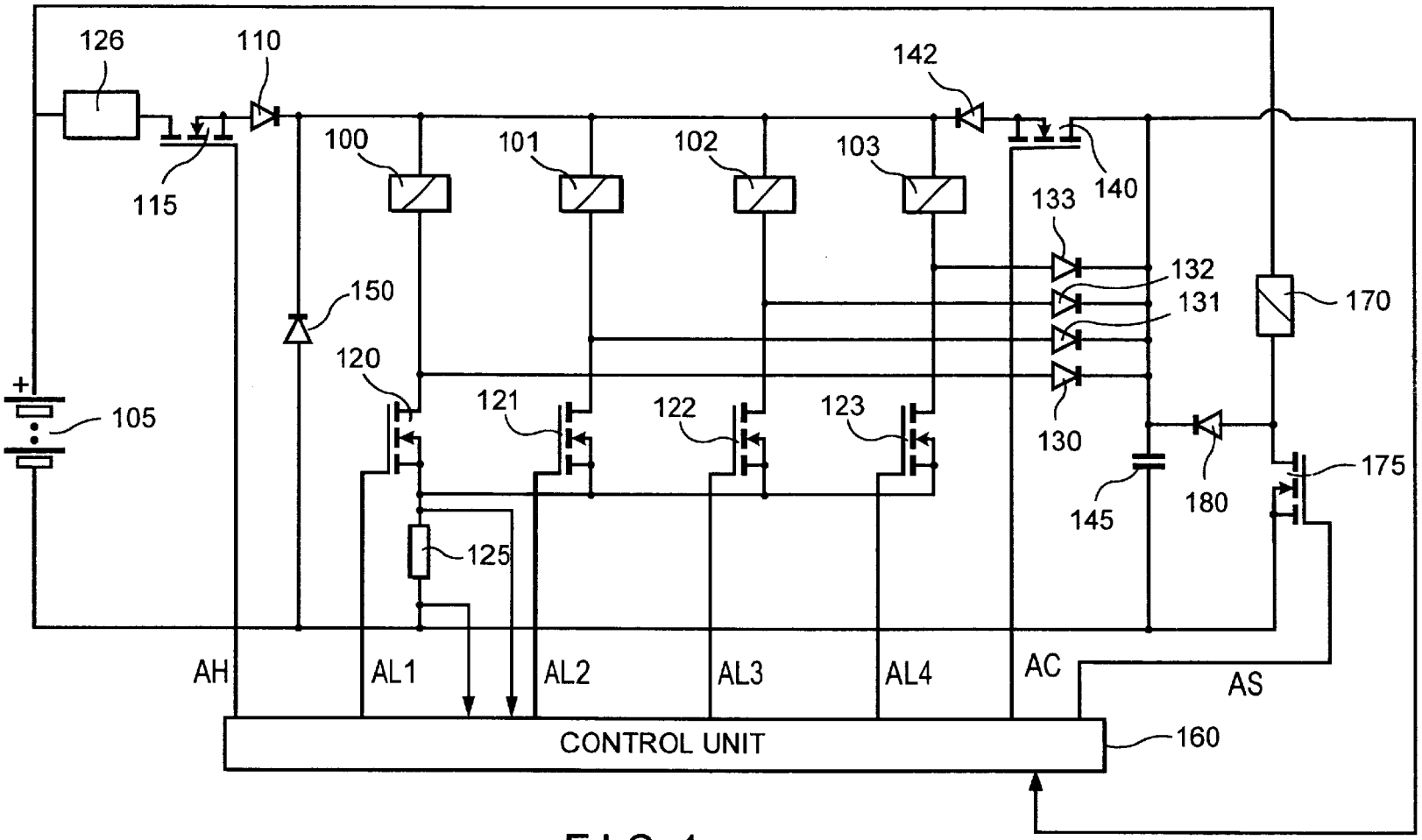
FIG. 1 shows the elements of the device according to the present invention.
Figure 2A:
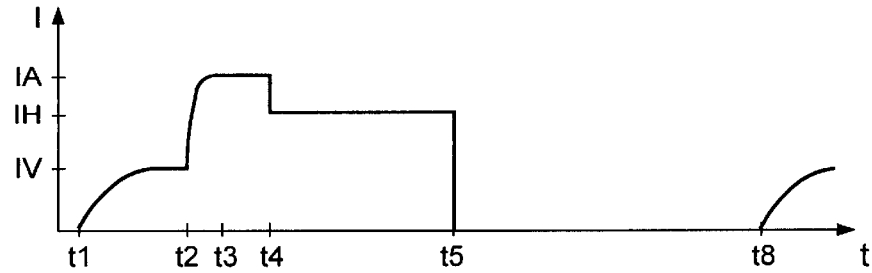
FIG. 2*a* shows a first signal plotted over time t.
Figure 2B:
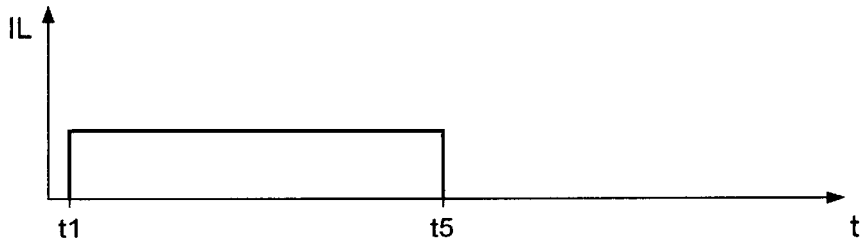
FIG. 2*b* shows a second signal plotted over time t.
Figure 2C:
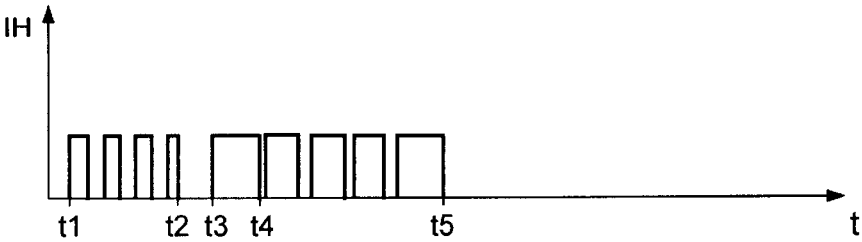
FIG. 2*c* shows a third signal plotted over time t.
Figure 2D:
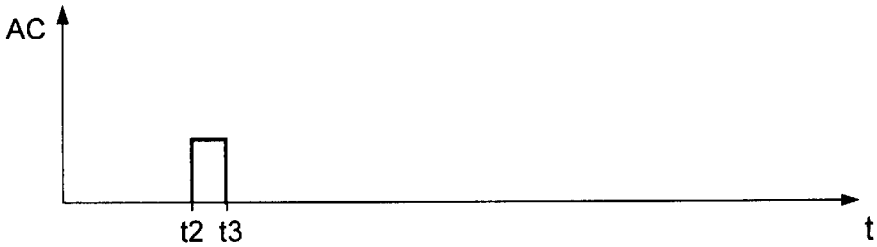
FIG. 2*d* shows a fourth signal plotted over time t.
Figure 2E:
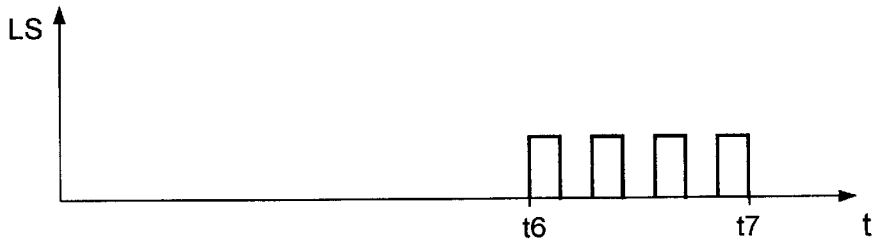
FIG. 2*e* shows a fifth signal plotted over time t.

FIG. 1 shows the elements of the device according to the present invention. The engine depicted in the specific embodiment is a four-cylinder internal combustion engine. Allocated to each consumer is an injection valve and, to each injection valve, a cylinder of the internal combustion engine. Internal combustion engines having a greater number of cylinders require proportionately more valves, switching elements, and diodes.

Four consumers are denoted by 100, 101, 102 and 103. Each of consumers 100 through 103 has a terminal connected via a common switching element 115, a diode 110, and a measuring means (instrument) 125, to a voltage supply 105.

Diode 110 is configured so that its anode is connected to switching element 115 and its cathode to consumers (100 through 103). Switching element 115 is preferably a field-effect transistor.

Each second terminal of consumers 100 through 103 is connected via a second switching element 120, 121, 122 and 123 to a resistance element 125. Switching elements 120 through 123 are likewise preferably field-effects transistors. Switching elements 120 through 123 are described as low-side switches, and switching element 115 as a high-side switch. The second terminal of resistance element 125 is connected to the second terminal of the voltage supply.

Assigned to each consumer 100 through 103 is a diode 130, 131, 132 and 133. The anode terminal of the diodes is in contact in each case with the connection (junction) point between the consumer and the low-side switch. The cathode terminal is linked to a capacitor 145, as well as to a further switching element 140. The second terminal of switching element 140 is in contact via a diode 142 with the first terminals of consumers 100 through 103. Switching element 140 is likewise preferably a field-effect transistor. This switching element 140 is also described as a booster switch. The second terminal of capacitor 145 is likewise connected to the second terminal of supply voltage 105.

High-side switch 115 receives a drive signal AH from a control unit 160. Switching element 120 receives a drive signal AL1 from control unit 160; switching element 121 a drive signal AL2; switching element 122 a drive signal AL3; switching element 123 a drive signal AL4; and switching element 140 a drive signal AC. The voltage applied to capacitor 145 is fed to control unit 160. In addition, control unit 160 evaluates the currents flowing through the consumers. For this, voltage values USHO and USH are detected.

A diode 150 is connected between the second terminal of voltage supply 105 and the junction point between diode 110 and the first terminals of consumers 100 through 103. In this case, the anode of the diode is connected to the second terminal of voltage supply 105.

Resistor 125 can be used to determine the current flowing through the consumer.

When the depicted arrangement is used, it is only possible to measure current using current sensing resistor (shunt) 125 when the one of switching elements 120 through 123 and one of high-side switches (115, 140) is closed, or when the consumer is in free-running mode via diode 150 and one of switching elements 120 through 123. To also be able to detect the current when the lowside switches are open, the current-sensing resistor can also be arranged at a different location. For example, the second terminal of capacitor 145 can be connected to the junction point between current sensing means 125 and switching element 120 through 123. In this case, a current measurement is also possible given a blocked (effectively non-conducting) low-side switch. In addition, the current-sensing means can be configured between the voltage supply and the high-side switch, i.e., in the first or second terminal of the consumers.

In place of resistor 125, or in addition to it, another resistor 126 can be arranged between the first terminal of voltage supply 105 and high-side switch 115. This resistor 126 can likewise be used to measure current.

The junction point between switching element 140 and capacitor 145 is in contact with the cathode of a further diode 180. The anode of diode 180 is connected to the junction point between an inductor 170 and a further switching element 175. Switching element 175 is described as a charging switch. A second terminal of the additional switching element is connected to the second terminal of capacitor 145 or to the second terminal of supply voltage 105. In addition, inductor 170 is connected to the first terminal of the supply voltage.

Inductor 170, charging switch 175, and diode 180 form a voltage transducer. In place of these elements, a voltage transducer of a different design can also be used, in particular a DC/DC direct voltage converter. The charging switch likewise receives a drive signal AS from control unit 160.

In each metering cycle, the distinction is made among various phases. In a phase 0, before instant t1, which is prior to activation of the consumer, the output stage is switched off. Drive signals AC, AH and AL are at low potential. This means that high-side switch 115, low-side switch 120 through 123, and booster switch 140 block the flow of current. No current flows through the consumers. Capacitor 145 is charged to its maximum voltage UC, which is preferably greater than supply voltage Ubat. This maximum voltage assumes, for example, a value of about 80 volts, whereas the voltage of the voltage supply assumes a value of about 12 volts.

In a first phase between instants t1 and t2, immediately before the actual activation, and described as the pre-flow phase, drive signal AC for booster switch 140 remains at its level, so that switch 140 continues to block. Drive signals AH and AL for high-side switch 115 and for the low-side switch allocated to the consumer are set to a high-level, so that these switches release the current flow. Thus, a current flows from voltage supply 105, from high-side switch 115 via diode 110, from the consumer, the corresponding low-side switch, and the current-sensing resistor 125, back to voltage source 105. High-side switch is operated in a timed cycle to control the current, which is detected using current-sensing resistor 125, to a predefinable value for the pre-flow IV. This means that upon reaching the setpoint current IV for the inrush current, high-side switch 115 is driven so that it blocks. It is released again when it falls below a further threshold.

The setpoint value for the pre-flow current IV is selected to enable a magnetic field to build up in the consumer, the magnetic field not sufficing, however, to switch the consumer.

A free-wheeling circuit operates in response to a blocked high-side switch 115. The current flows from the consumer, through the low-side switch, resistor 125 and free-running diode 150.

The first phase ends when the consumer is actually driven at instant t2. A second phase is defined by instants t2 and t3. The duration of the second phase is also described as booster time. The second phase coincides with the start of activation and is also described as booster phase. In this phase, the low-side switch allocated to the consumer for metering fuel is driven. This means that signal AL assumes a high level in phase 1. At the same time, drive signal AC for booster switch 140 assumes a high-level, tripping switch 140 by force. The position of the high-side switch is not significant. As a rule, high-side switch 115 is not driven; it is blocking in the second phase.

Activating the switching elements in this manner results in a current, also described as booster current, flowing from capacitor 145 via booster switch 140, the corresponding consumer, the low-side switch allocated to the consumer, and current-sensing means 125. In this phase, current I rises very quickly due to the high voltage at the consumer. At the start of actual activation, an elevated voltage, which is substantially greater than the supply voltage, is applied to the consumer. This voltage is also called booster voltage. The supply voltage usually assumes values of 12 or 24 volts, and the elevated voltage, values of about 40 through 90 volts. The second phase ends when the voltage applied to capacitor 145 falls below a defined value U2, or when the current in the consumer has reached a defined value.

A third phase, defined by instants t3 and t4, is described as the inrush-current phase. In this phase, the starting current is received by high-side switch 115, and the booster is inactivated. In the third phase, the drive signal for booster switch 140 is canceled, so that switch 140 is blocking. Drive signals AH and AL for high-side switch 115 and low-side switch allocated to the consumer are set to a high-level, so that these switches release the flow of current. Thus, a current flows from voltage supply 105 via high-side switch 115, diode 110, the consumer, the corresponding low-side switch, current-sensing resistor 125, back to voltage source 105. By operating high-side switch in a timed cycle, the current, which is detected using current-sensing resistor 125, is controlled in closed loop to a predefinable value for inrush current IA. This means that in response to the inrush current reaching setpoint current IA, high-side switch 115 is driven to be blocking. It is released again when a further threshold is fallen short of.

A free-wheeling circuit operates in response to a blocked high-side switch 115. The current flows from the consumer, through the low-side switch, resistor 125, and free-wheeling diode 150.

The third phase ends when control unit 160 detects the end of the inrush phase. This can be the case, for example, when a specific inrush time has come to an end, or when a switching-instant detection circuit recognizes that the solenoid-valve armature has reached its new end position. If the switching-instant detection circuit does not detect that the solenoid valve armature has reached its new end position within a predefined period of time, then this is indicative of an error.

The third phase is followed by a fourth phase, defined by instants t4 and t5, and also described as holding-current control. In a manner comparable to that of the third phase, the drive signal for the low-side switch remains at its high-level, i.e., the low-side switch allocated to the consumer remains closed. The opening and closing of high-side switch 115 adjusts the current flowing through the consumer to setpoint value IH for the holding current. A free-wheeling circuit operates in response to a blocked high-side switch 115. The current flows from the consumer, through the low-side switch, resistor 125, and free-wheeling diode 150. Phase 4 ends upon termination of the injection operation. Setpoint value IH for the retaining current is selected to be as small as possible, but to suffice to retain the consumer in its position.

A rapid extinction occurs particularly in response to the consumer de-energizing at instant t5. A rapid extinction can likewise occur in response to the transition between the in-rush current and phase 3 and the retaining current in phase 4. In response to the rapid extinction, the corresponding low-side switch is switched off, and high-side switch 115 remains tripped by force. As a result, the current flowing through the consumer drops rapidly to the value zero. At the same time, voltage U, applied to capacitor 145, rises. In the process, capacitor 145 is recharged with the energy released by the interruption.

In another embodiment of the rapid extinction, the high-side switch and the low-side switch are blocked.

In phases two and three, current is controlled by operating high-side switch in a timed cycle. In response to a blocked high-side switch, free-wheeling diode 150 is active. In these phases, the current drops off slowly. This leads to a lower operating frequency.

In a fifth phase between instants t5 and t6, the output stage is inactive, i.e., no metering of fuel takes place. This means that drive signal AC for booster switch 140, drive signal AH for the high-side switch and, and drive signal AL for the low-side switch always assume a low-level, and eill switches are blocking. The current flowing through the consumer remains at 0.

In a sixth phase following activation, defined by instants t6 and t7, and also described as the charging phase, charging switch 175 is forced into its conductive state by drive signal AS. As a result, a current flow is initialized in inductor 170. The current flows from a voltage source 105 via switch 175 and inductor 170 into voltage source 105. After a predefined time period selected to ensure sufficient storage of energy in the inductor, the charging switch is driven to open. This effects, in turn, a rapid extinction of inductor 170 via diode 180 into capacitor 145. As a result, the voltage being applied to capacitor 145 rises. This process is repeated until the voltage at capacitor 145 reaches a predefined value U1. Provision can optionally be made for a predefined number of activation operations to take place or for charging switch 175 to be driven for a predefined period of time with a clocked signal having a predefined frequency and pulse duty factor.

Since the DC/DC converter does not use any consumer for the recharging operation, it can recharge the capacitor at any time.

It is preferably provided, however, that the DC/DC converter not be active in the booster phase and the in-rush phase, i.e., betwe(en instants t2 and t4, since otherwise very high current values can occur, which would have to be made available by supply voltage 105.

In the seventh phase that follows between instants t7 and t8, all drive signals are canceled, and all switches are forced into their blocked state. This phase corresponds to the 0 phase.

One embodiment of the present invention can also provide that the energy being released in response to switch-off operation not be recharged into the capacitor, this capacitor then merely being charged by the voltage transducer.

In the following, the procedure according to the present invention is described on the basis of the example of booster voltage. Accordingly, the booster current and/or the booster time can be used in place of the booster voltage.

Figure 3:
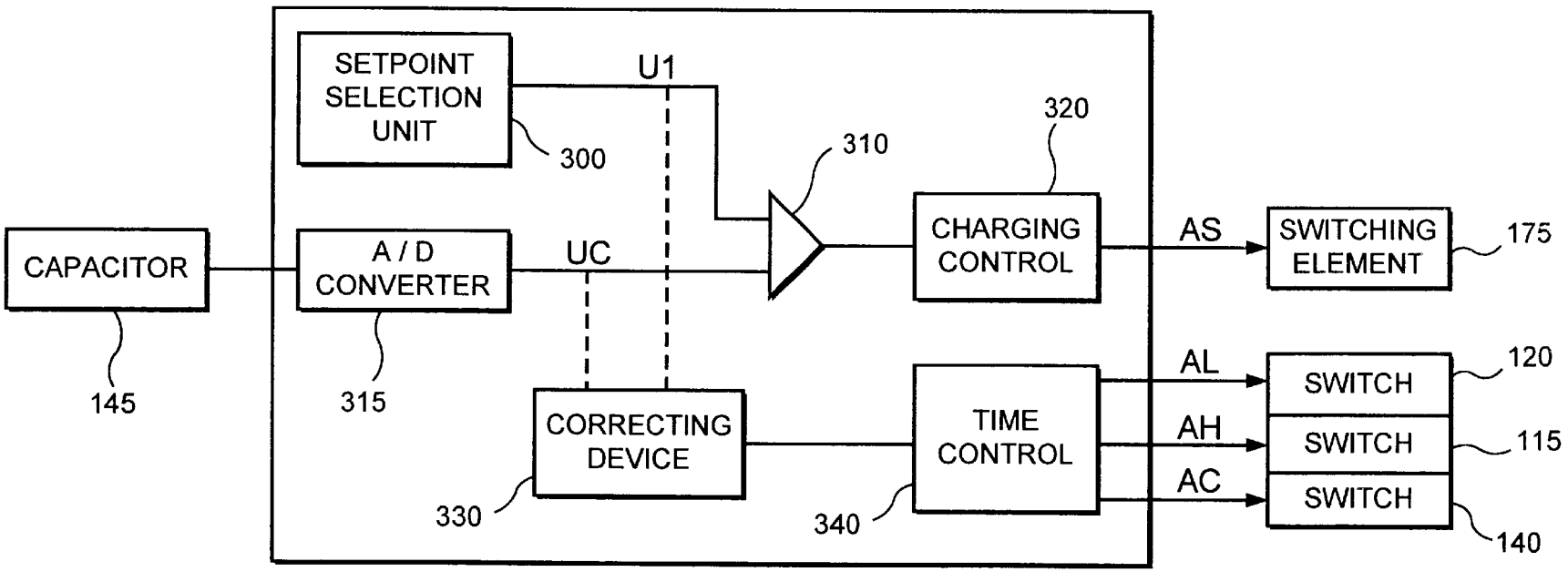
FIG. 3 shows a detail of the closed-loop control.

Individual elements of the control unit are depicted in detail in FIG. 3. Elements already described in FIG. 1 are denoted by corresponding reference symbols.

A setpoint selection unit 300 applies a signal U1 to a comparator 310. Applied to the second input of the comparator is output signal UC of an A/D converter 315, which converts the voltage applied to the booster capacitor into a corresponding signal UC. Comparator 310 applies a signal to charging control 320. Charging control 320 drives charging switch 175 accordingly. Setpoint value U1 and/or signal UC are processed by a correcting device 330. This device feeds a signal to time control 340, which drives the low-side switch, the high-side switch, and the booster switch.

The method of functioning of this device is described in the following on the basis of FIGS. 4*a*–4*c*. In a first specific embodiment shown in FIG. 4*a*, a first query 200 checks whether certain operating states, in which even a small booster voltage suffices, are at hand. If such an operating state is not present, then in step 205, setpoint value selection 300 sets value U1 for the booster voltage to a large value UCG, which is on the order of magnitude of about 70 to 90 volts. If such a state, in which a small booster voltage does suffice, is at hand, a value within the range of 40 to 70 volts is preset in step 210 for booster voltage USK. In step 215, the time quantities defining the start and end of injection are subsequently corrected by correcting device 330 as a function of smaller booster voltage UCK.

Charging switch 175 continues to be driven in accordance with the sixth phase until the comparator recognizes that the proper booster voltage value is reached. When, in step 220, the booster voltage is reached or the predefined instants t1 through t5 are reached, the switching elements are driven accordingly in step 220.

Smaller booster voltages are preferably selected when a direct-injection gasoline engine is in so-called homogeneous operation. On the other hand, in so-called stratified operation, large UCG values for the booster voltage are used. The prolonged switching times resulting from the smaller booster voltage are corrected in homogeneous operation by correcting the injection time and/or the so-called pre-storage angle in step 215. This measure results in a substantial reduction in the power loss dissipation of the output stage in homogeneous operation. Alternatively or in addition to the homogeneous operation, the switch-over to smaller booster voltages can also be made when working with full load, when a specific speed threshold is exceeded or a specific period of injection is exceeded, or when the fuel pressure is lowered.

In stratified operation, high booster voltages are preset to ensure short switching times.

The distinction between homogeneous operation and stratified operation is made, in particular, in gasoline engines having direct injection of fuel. The switch-over between homogeneous and stratified operation is made as a function of the operating state of the internal combustion engine. In the process, preferably the load and speed of the internal combustion engine are considered.

The homogeneous operation largely corresponds to the operation of a customary internal combustion engine having externally supplied ignition. In the stratified operation, the fuel is injected at an elevated pressure, the result being an inhomogeneous distribution of the fuel concentration in the combustion chamber. The start and duration of injection have a significant effect on the combustion. Often, the injection is subdivided into a plurality of partial injections.

In accordance with the present invention, at suitable working points, for example in homogenous operation, the voltage is lowered at the booster capacitor by a switch-over operation to reduce the maximum power loss dissipation of the output stage. In stratified operation, the booster voltage is increased again to achieve the required, short injection times.

Figure 4A:
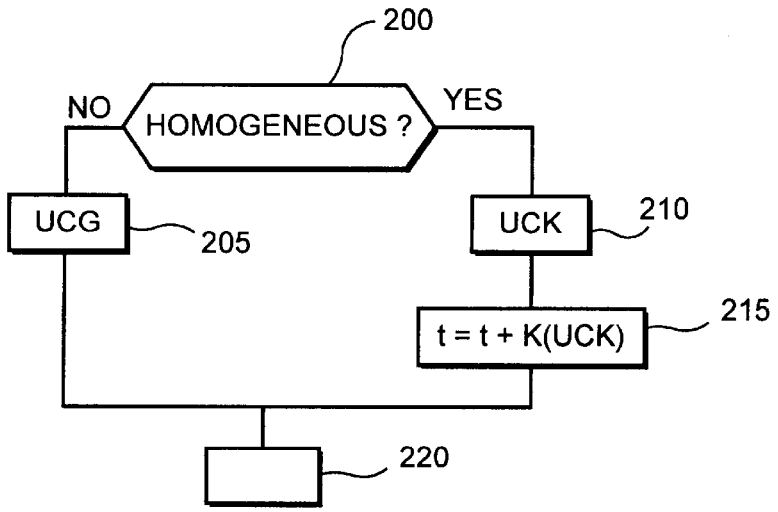
FIG. 4*a* shows a first specific embodiment as a flow chart.
Figure 4B:
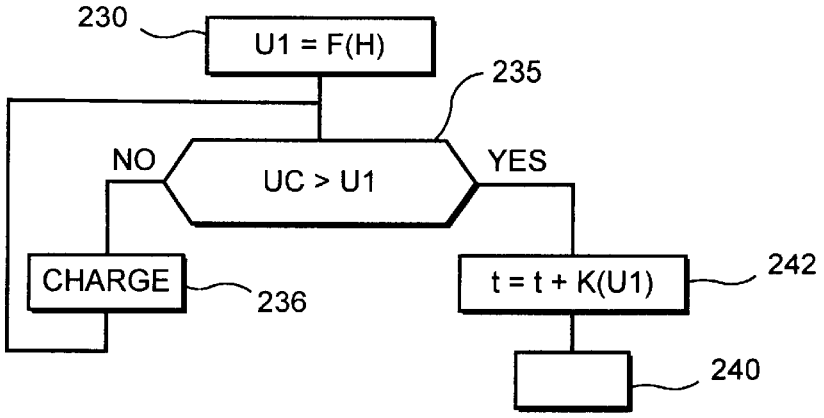
FIG. 4*b* shows a second specific embodiment as a flow chart.

Another embodiment is shown in FIG. 4*b*. In a first step 230, setpoint selection 300 specifies booster voltage U1 as a function F of an operating parameter H. Booster voltage U1 is preferably read out of a characteristics map as a function of various operating parameters. It is especially advantageous when the booster voltage is able to be predefined as a function of one or a plurality of the variables, speed of the internal combustion engine, engine torque, driving duration, fuel pressure, temperature, and supply voltage.

Subsequent query 235 checks whether voltage UC being applied to the booster capacitor is greater than threshold value U1. If this is not the case, the capacitor is charged again in step 236. If query 235 recognizes that voltage UC at the booster capacitor is greater than threshold value U1, then the injection follows in step 240, the switching elements being driven at predefined times t1 through t5.

It is particularly advantageous if, prior to activation, those times when the solenoid valves are driven are corrected as a function of predefined booster voltage U1 in accordance with step 215, prior to activation in step 242.

As operating parameters in step 330, the speed and/or the injection period are considered in particular. In accordance with the present invention, the value can also be predefined as a function of whether the internal combustion engine is working in homogenous or in stratified operation.

This procedure is particularly advantageous when the time intervals between two injections and/or between two partial injections of one injection assume very small values in specific operating states. Such operating states are present, for example, when a switch is made to homogenous operation, following stratified operation, at a high speed, and when working with dual and multiple injections. In these states, a minimum time interval between two injections is required for charging the booster capacitor to the defined voltage value. This time is to be calculated so as to enable the DC/DC converter used to be charged to the set voltage value, even under unfavorable conditions. By specifying the booster voltage, the time interval for the charging operation can be shortened when it is no longer necessary for the charging time to conform to the maximum value of the booster voltage in these operating states.

Therefore, in accordance with the present invention, the booster voltage is predefined as a function of the operating state, as depicted in FIG. 4*b*. As a result, shorter charging times and, thus, shorter time intervals are achieved between two injections. In so doing, the voltage values of the booster capacitor are defined. The slower turn-on times resulting from the low booster voltage and, thus, small injection quantities can be corrected by correcting the injection time and/or the pre-storage angle in step 242.

Figure 4C:
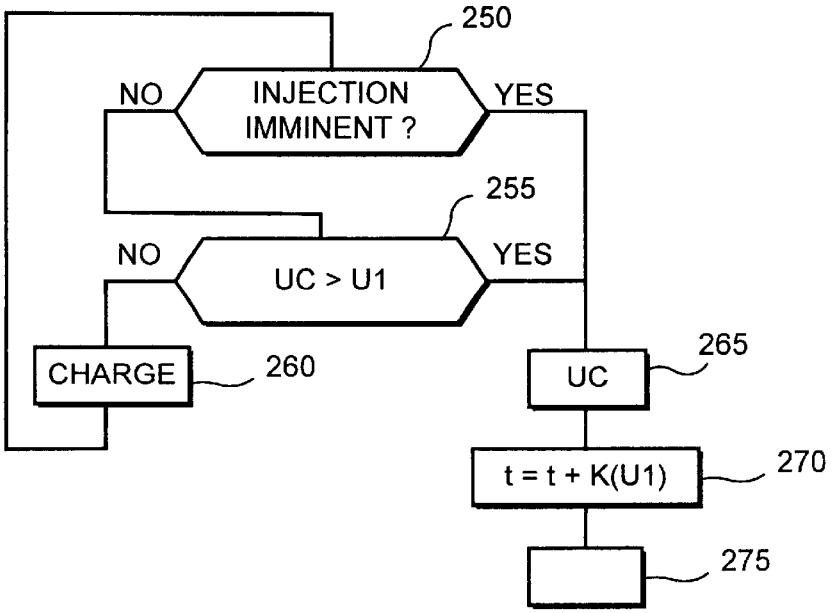
FIG. 4*c* shows a third specific embodiment as a flow chart.

Another advantageous embodiment is illustrated in FIG. 4*c*. In this embodiment, the booster voltage is measured using an AD converter immediately before the start of injection. In the problematic working points mentioned above, it is possible in this case to observe a preset time interval between two injections, to achieve optimum combustion. Using the voltage value measured at the booster capacitor, the ensuing slower turn-on times and the resultant smaller injection quantities, are corrected.

For this, it is checked in step 250 whether an injection is imminent. If this is not the case, then a query 255 checks whether booster voltage UC is greater than a predefined threshold value U1. If this is not the case, then the charging operation continues in step 260. If query 250 recognizes that an injection is immediately imminent, and/or query 255 recognizes that booster voltage UC is greater than the setpoint value, then the active booster voltage is detected in step 265. In subsequent step 270, the drive times are corrected accordingly as a function of measured booster voltage UC.

The solenoid valve is subsequently driven in step 275.

It is particularly advantageous when the correction is performed in steps 215 and 242, in partial FIGS. 4*a* and 4*b*, likewise as a function of a measured value for the booster voltage.

What is claimed is:

1. A method for driving at least one solenoid valve for controlling an injection of fuel into an internal combustion engine, comprising the steps of:

predefining at least one variable as a function of at least one operating parameter of the internal combustion engine, the at least one variable influencing at least one of an energy and a power output received by the at least one solenoid valve at a start of a driving of the at least one solenoid valve; and supplying the at least one solenoid valve with an elevated voltage at the start of the driving of the at least one solenoid valve, wherein the elevated voltage is greater than a voltage supplied for a further driving of the at least one solenoid valve.

2. The method according to claim 1, wherein the at least one variable includes at least one of a booster voltage, a booster current and a booster time.

3. The method according to claim 1, further comprising the step of predefining at least one of the energy and the power output as a function of at least one of an engine speed, an engine torque, a driving duration, a fuel pressure, a temperature and a supply voltage.

4. The method according to claim 1, further comprising the step of predefining at least one of the energy and the power output as a function of a presence of one of a homogenous operation and a stratified operation.

5. The method according to claim 1, wherein the elevated voltage is smaller when an at least one specific operating state is present, as compared to when the at least one specific operating state is not present.

6. The method according to claim 1, further comprising the step of selecting the elevated voltage from a set of at least three values, prior to the start of the driving of the at least one solenoid valve, as a function of an operating state.

7. The method according to claim 1, further comprising the step of correcting a period of the injection as a function of elevated voltage.

8. The method according to claim 1, further comprising the step of correcting a period of the injection as a function of a selected value for the elevated voltage.

9. The method according to claim 1, further comprising the step of correcting a period of the injection as a function of a measured value of the elevated voltage.

10. The method according to claim 1, further comprising the step of predefining at least one of the energy and the power output as a function of an engine speed.

11. The method according to claim 1, further comprising the step of predefining at least one of the energy and the power output as a function of an engine torque.

12. The method according to claim 1, further comprising the step of predefining at least one of the energy and the power output as a function of a driving duration.

13. The method according to claim 1, further comprising the step of predefining at least one of the energy and the power output as a function of a fuel pressure.

14. The method according to claim 1, further comprising the step of predefining at least one of the energy and the power output as a function of a temperature.

15. The method according to claim 1, further comprising the step of predefining at least one of the energy and the power output as a function of a supply voltage.

16. A device for driving at least one solenoid valve for controlling an injection of fuel into an internal combustion engine, comprising:

means for predefining at least one variable as a function of at least one operating parameter of the engine, the at least one variable influencing at least one of an energy and a power output received by the at least one solenoid valve at a start of a driving of the at least one solenoid valve; and means for supplying the at least one solenoid valve, at the start of the driving of the at least one solenoid valve, with an elevated voltage, wherein the elevated voltage is greater than a voltage supplied for a further driving of the at least one solenoid valve.

* * * * *

UNITED STATES PATENT AND TRADEMARK OFFICE

CERTIFICATE OF CORRECTION

PATENT NO. : 6,250,286 B1
APPLICATION NO. : 09/361922
DATED : June 26, 2001
INVENTOR(S) : Guenter Hoenig et al.

It is certified that error appears in the above-identified patent and that said Letters Patent is hereby corrected as shown below:

On the TITLE PG, ITEM (56) references cited, U.S. patent documents, please add the following patents:

-- 4,355,619 and 5,839,412 --.

And under foreign patent documents, please add the following patents:

-- 0 305 344 3/1989 (EP) and 0 849 461 6/1998 (EP) --.

Signed and Sealed this

Fourth Day of March, 2008

JON W. DUDAS
*Director of the United States Patent and Trademark Office*